US009961971B2

(12) United States Patent
Bryant

(10) Patent No.: US 9,961,971 B2
(45) Date of Patent: May 8, 2018

(54) JEWELLERY RETENTION DEVICE

(75) Inventor: Gary Bryant, Bournville (GB)

(73) Assignee: BRYLOCK INNOVATIONS LIMITED, Birmingham (GB)

( * ) Notice: Subject to any disclaimer, the term of this patent is extended or adjusted under 35 U.S.C. 154(b) by 0 days. days.

(21) Appl. No.: 13/575,948

(22) PCT Filed: Feb. 4, 2011

(86) PCT No.: PCT/GB2011/000141

§ 371 (c)(1),
(2), (4) Date: Jul. 28, 2012

(87) PCT Pub. No.: WO2011/095773

PCT Pub. Date: Aug. 11, 2011

(65) Prior Publication Data

US 2012/0297824 A1 Nov. 29, 2012

(30) Foreign Application Priority Data

Feb. 4, 2010 (GB) ..... 1001795.2

(51) Int. Cl.
*A44C 7/00* (2006.01)

(52) U.S. Cl.
CPC ..... *A44C 7/003* (2013.01); *Y10T 24/45262* (2015.01)

(58) Field of Classification Search
CPC ..... A44C 7/003
USPC ..... 63/35, 12; 24/705, 453
See application file for complete search history.

(56) References Cited

U.S. PATENT DOCUMENTS 216,954 A * 7/1879 Heckman ..... 24/705
335,100 A * 2/1886 Adams & Dodge ..... 24/90.5
1,970,901 A 7/1932 Rohrs
2,882,702 A * 4/1959 Goldberg et al. ..... 63/14.3
(Continued)

FOREIGN PATENT DOCUMENTS

FR 454161 A * 6/1913 ..... A44C 7/003
FR 454161 A 12/2015
(Continued)

OTHER PUBLICATIONS

International Search Report for PCT/GB11/000141, dated Jul. 5, 2011.

(Continued)

*Primary Examiner* — Emily M Morgan
(74) *Attorney, Agent, or Firm* — Young & Thompson

(57) ABSTRACT

A jewellery retention device for fastening a jewellery item which comprises a retention post, said retention device comprising a body and having an opening configured to receive a post, said retention device comprising a friction member having a first end associated with the body and a second end which is configured to be contacted by the post upon insertion of the post, said body additionally providing an abutment to support the post and provide a reaction to the force imposed on the post by said second end of the friction member, said opening comprising at least in part a receiving region through which the post may move substantially freely and into which the post may be laterally displaced and received from between the first friction member and abutment in a direction substantially perpendicular to the length of the post.

15 Claims, 7 Drawing Sheets

(56) References Cited

U.S. PATENT DOCUMENTS

| | | | | | |
|---|---|---|---|---|---|
| 3,040,406 | A | * | 6/1962 | Artzt | 24/453 |
| 4,245,484 | A | | 1/1981 | Block | |
| 4,299,101 | A | * | 11/1981 | Block | 63/12 |
| 4,517,816 | A | * | 5/1985 | Hess | 63/12 |
| 6,138,475 | A | * | 10/2000 | Kohl et al. | 63/12 |
| 6,443,679 | B1 | | 9/2002 | Schwarz | |

FOREIGN PATENT DOCUMENTS

| | | | | | |
|---|---|---|---|---|---|
| GB | 218 7930 | A | | 9/1987 | |
| WO | WO2007043179 | | | 4/2007 | |
| WO | WO2008/065380 | | | 6/2008 | |
| WO | WO 2008065380 | A1 | * | 6/2008 | A44C 7/00 |

OTHER PUBLICATIONS

EPO Examination Report, dated Jul. 31, 2015, European Patent Office.

* cited by examiner

JEWELLERY RETENTION DEVICE

The present invention relates to a retention device for securing an object in position. Specifically, but not exclusively, it relates to the securing of jewellery such as piercings in, for example, ears.

Typically, jewellery such as piercings and especially pierced earrings have either a straight post or hook that is inserted through a piercing in the ear lobe or the pinnae. The earring is held in place by means of an earring back or clutch in the case of a straight earring post or gravity in the case of a hook.

Generally, the current principal of how earrings are retained on the wearer fall into three categories.

A first method is where the earring has a straight post, sometimes with an indented shoulder, which is retained in place by an earring retention device or "back" which grips the earring post by friction only. Since the level of friction cannot be so high as to make it difficult to insert the post, the level of friction is often not high enough to retain the post effectively and the back may become dislodged by jolts and knocks. Additionally, this type of retention device has a tendency to both wear the post and become worn itself and therefore loosens over time; potentially allowing the earring to become more easily detached from the wearer. Attempts have been made to improve on this method by making the indent deeper on the post or by increasing the friction applied by the retention device. However, both of these improvements have a detrimental effect for the user as more effort is required to push the retention device onto the post and subsequently remove it.

A second method is where the earring is hooked through the ear and has no further means of retention, relying on gravity to secure the earring on the user.

A third method is where the earring has a straight post which is threaded. An appropriately screwed earring back is then provided which is screwed onto the post once the earring is inserted through the ear. This type of retention device has a tendency to unscrew due the movement of the wearer and eventually becomes detached allowing the earring to fall from the wearer. It takes considerably more time to attach this type of retention device, and the threads can act as traps for bacteria which is unhygienic.

There are other types of earring "backs" available other than described above, however they normally require the specific modification of the piercing post and therefore can only be employed as part of the manufacture of a new earring or piercing.

In the case of the first method described above examples are to be found in WO 2007043179, FR 454161 and CH 295468. More recently there has been described in WO 2008065380 a retention device which addresses at least some of the difficulties referred to in the above discussion of the first method, and the present invention seeks to provide a device which is a further improvement.

The method of retention currently used for both necklaces and bracelets fall mainly into two categories.

A first and common method is whereby one end of the necklace or bracelet has a ring attached and the other end has a spring-loaded catch. Although once connected this method is secure, the action required to join and release the ring and the clasp can often be difficult due to the need to achieve a non axial alignment between the components to be joined.

The second method employed is where one end of the necklace or bracelet has a slotted tongue and the other end has a hinged box clasp. Joining the two ends together requires the hinged box clasp to be closed about the slotted tongue. Not only can this action be awkward, but also successful retention relies on the clasp being fully closed. The clasp can also become worn over time, allowing it to unintentionally disengage such that the necklace or bracelet becomes detached from the wearer.

It is apparent that many currently available retention devices used for earrings, pierced jewellery, necklaces, bracelets, and other such items, can become unintentionally detached from the wearer. The result at best being inconvenience and at worst meaning the loss of the item, along with the, associated potentially emotional and financial loss.

It is an object of the inventor to improve on these designs.

In accordance with one of its aspects the present invention provides a jewellery retention device for fastening a jewellery item which comprises a retention post, said retention device comprising a body and having an opening configured to receive a post, said retention device comprising a friction member having a first end associated with the body and a second end which is configured to be contacted by the post upon insertion of the post, said body additionally providing an abutment to support the post and provide a reaction to the force imposed on the post by said second end of the friction member, said opening comprising at least in part a receiving region through which the post may move substantially freely and into which the post may be laterally displaced and received from between the first friction member and abutment in a direction substantially perpendicular to the length of the post.

The body may be substantially planar and the first friction member may be co-planar with said body. Alternatively the first friction member may be oriented at an oblique angle relative to the body and/or post.

The first friction member and body may be integral or may be separate components which, optionally, may be non-releasably secured relative to one another.

At least one of the body and first friction member, or inter-connection therebetween may be deformable whereby the spacing between the second end of the friction member and the abutment may be increased by deformation of one or more of the body, first friction member and any inter-connection therebetween upon insertion of a post, and may return substantially to the original configuration upon removal of the post. One or more of said components may be capable of elastic type deformation in order to provide a resiliency feature for allowing said deformation.

The retention device may comprise a second friction member having a second, distal end which serves as said abutment. The second friction member may extend from the body in a direction substantially opposite to the direction in which the first friction member extends from the body. Both friction members may lie at the same side of the body The second friction member in general may have a construction and configuration substantially corresponding to that of the first friction member. Thus it may lie inclined relative to the body and/or, when a post is in situ between the two friction members the two friction members, may be symmetrically disposed relative to the length of the post.

The second end of the first friction member and the abutment (such as that defined by either the body or a distal end of a second friction member) may lie close to one another, and optionally be in contact, prior to insertion of a post or preferably, lie slightly spaced by a distance less than the minimum cross-sectional dimension of the post thereby to assist with ease of insertion of the post. If spaced, the opening defined by said spacing may be contiguous with said post receiving region from which the post may be freely withdrawn.

One or each of the second end of the first friction member and abutment may be profiled to form a notch-like formation for providing a position of preferential location of the post in a lateral direction substantially perpendicular to the length of the post and the direction in which the second end of the first friction member and the abutment are movable relative to one another upon insertion of the post.

The opening defined by the retention device may comprise more than one post receiving region into which the post may be laterally displaced for subsequent removal of the retention device. The retention device may comprise two receiving regions symmetrically positioned at respective ends of the confronting surfaces of the second end of the first friction member and the abutment.

The body from which the first friction member extends may be substantially rigid or may be deformable in which case preferably it is elastically deformable whereby application of a force in a direction substantially parallel with the direction in which the second end of the first friction member and the abutment move relative to one another may act to reduce the frictional force imposed on the post by the friction member and abutment.

The body may be provided with at least one arm which projects therefrom and is movable in order to urge the friction member in a direction away from the post in the manner described in our International patent publication WO 2008/065380. The body may comprise other features described in that patent publication in respect of a deformable body, including, for example, the feature of an actuation arm which is curved.

The body may comprise an auxiliary formation which lies spaced from the abutment and second end of the first friction member as considered in a direction of post insertion to act as an alignment guide through which the end of a post may be introduced and thereby guided to align with a position between the friction member and abutment.

The body may provide support for a guide component which defines a guide orifice. Said guide component may be supported by said auxiliary formation. In the case of a retention device comprising a body and a guide, the body and guide may be slidable relative to one another in said lateral direction whereby a retained post may be released by sliding the body and guide relative to one another. Return of the guide and body to an orientation in which the guide will guide an inserted post to lie between the confronting surfaces of the friction member and abutment may be manual or the retention device may comprise means, such as spring biasing means which automatically urges the body and guide to revert to their original configuration.

Although it is referred to above that the body may be substantially planar and that the or each friction member may be inclined relative to the body, such that the friction member extends obliquely relative to the direction of insertion of the post, the base may be, for example, of a V shape as viewed in a sideways direction such that the base may comprise two portions each angled relative to the direction of post insertion and which may be angled to lie co-planar with one or each of a pair of friction members.

According to another aspect of the present invention there is provided a retention device for fastening an item comprising a body defining an opening configured to receive a post of the item, and a first friction member having a first end attached to the fastener body and a second end which at least partially defines the opening and is configured to contact the post upon insertion, the first friction member oriented such that movement of the second end of the first friction member relative to the first end in a first direction causes the opening to become larger, and movement of the second end of the first friction member relative to the first end in a second direction causes the opening to become smaller wherein a first force applied to the post in an insertion direction urges the first end of the first friction member in the first direction and a second force applied to the post in a removal direction urges the first end of the first friction member in the second direction such that a first frictional force between the retention device and the post opposing the first force is less than a second frictional force between the retention device and the post opposing the second force, and the post being removable in a lateral direction relative to the length of the post and direction of said frictional force from an engaged to a disengaged position.

The invention further provides a retention device actuable by movement in a second direction, substantially perpendicular to the first and second directions, to move a retained post to a release position at which it is disengaged from the friction members.

The invention provides also the combination of a jewellery retention device and an item of jewellery having a post. Although the post may be of a type having a retention notch, it may be devoid of any such notch and may have a smooth or only lightly textured surface for contact by the friction member and abutment of the retention device.

Embodiments of the present invention will now be described in detail with reference to the following figures in which.

Figure 24:
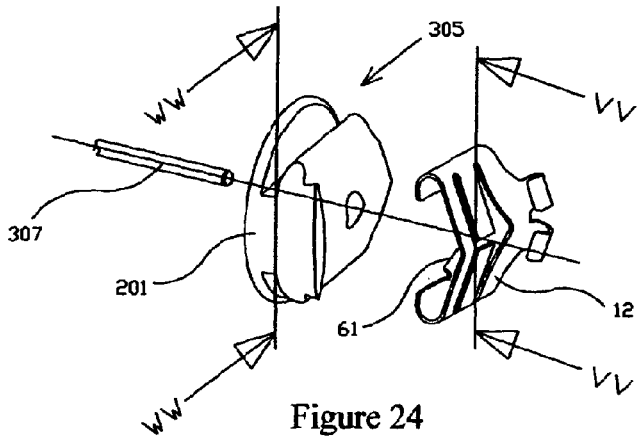
FIG. 24 is a perspective view of a retention device of a ninth embodiment.
Figure 25:
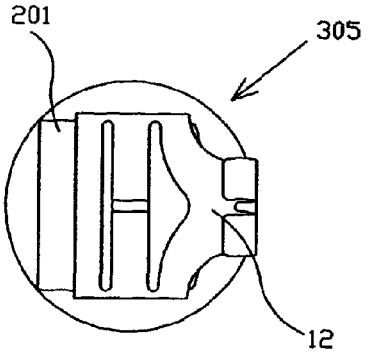
Figure 26:
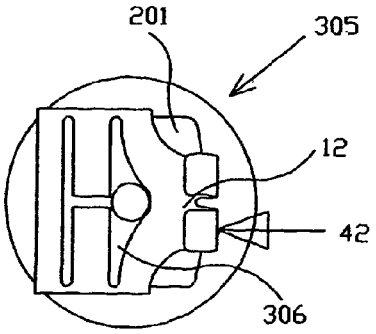
Figure 27:
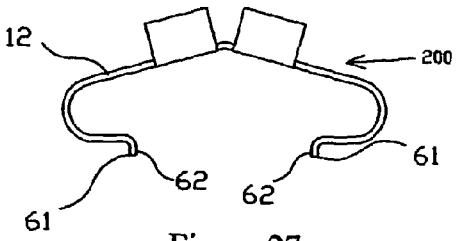
Figure 28:
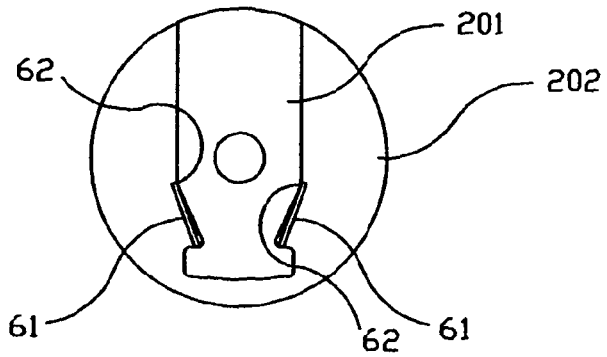
Figure 29:
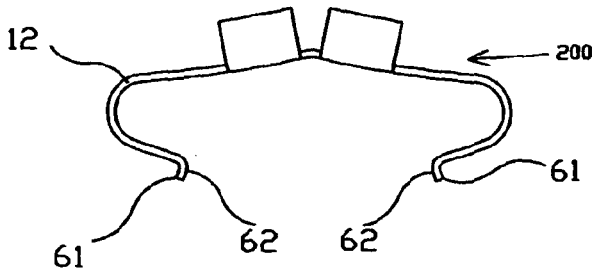
Figure 30:
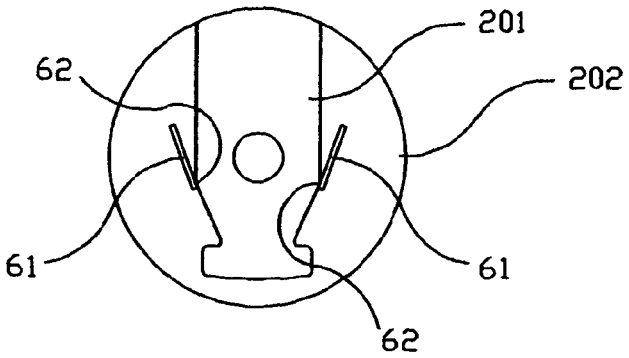

FIGS. 25 and 26 show the device of FIG. 24 respectively in an orientation for post insertion and an orientation for post removal, and FIGS. 27 and 29 are sections in a plane containing the longitudinal axis of the post 307 and the lines VV-VV of FIG. 24, and FIGS. 28 and 30 are sections in a plane perpendicular to the longitudinal axis of the post and containing the lines WW-WW of FIG. 24.

In a first embodiment of the present invention, referring to FIGS. 1, 2, 3, 4, and 5, there is shown a retention device 10 comprising a body 12, first friction member 14 and second friction member 16. Body 12, friction member 14 and second friction member 16 are integral and formed from a single piece of sheet metal; e.g. stainless steel as appropriate. The friction members 14, 16 are formed by creating two parallel spaced vertical slots 26, and a single horizontal space 28 in the body 12 forming an "H" shape.

The friction members 14, 16 are therefore joined to the body 12 at first ends 18, 20 respectively, which first ends span the distance between the vertical slots 26. The friction members 14, 16 are free at second ends 22, 24 respectively, formed by the horizontal space 28. Space 28 leads to a post receiving and receiving region 38 that is larger than the cross-sectional area of post 36.

Figure 2:
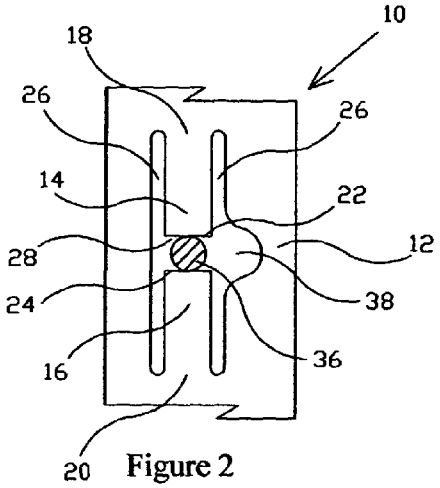
FIG. 2 is a front view of the retention device of FIG. 1 with post inserted.
Figure 3:
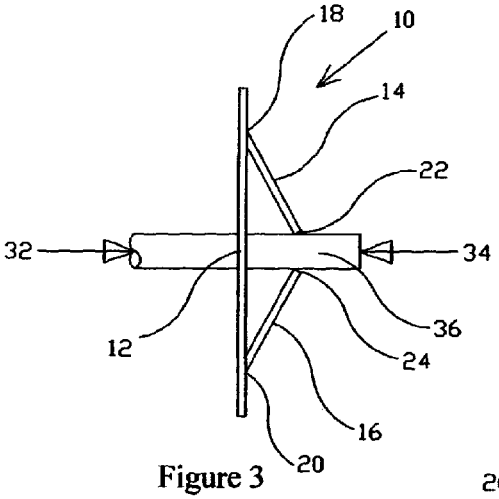
FIG. 3 is a side view of the retention device of FIG. 2 with post inserted.

The friction members 14, 16 are plastically deformed at first ends 18, 20 such that their second ends 22, 24 have been moved in a first direction (denoted by arrow 32 in FIG. 3) and they form an angle with the body 12. Referring to FIGS. 2 and 3 an enlarged space 28 is formed by this action, defined partially by the second ends 22, 24 of the friction members 14, 16. Any movement of the second ends 22, 24 in the first direction 32 causes the space 28 to become larger. Similarly any movement of the second ends 22, 24 in a second direction 34 (opposite to the first direction 32), for example under the action of attempting to pull the post back through the space 28, causes the space 28 to become smaller and for a firmer grip to be exerted on the post.

In use, the retention device 10 is positioned such that a post 36 of a piece of jewellery is inserted in the first direction into the space 28 as shown in FIGS. 2, 3, 4 and 5. In the embodiments described the post 36 is circular in cross-section but may take any substantially prismatic or cylindrical shape.

Figure 1:
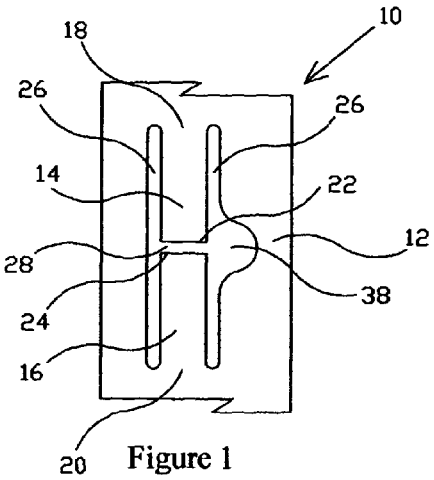
FIG. 1 is a front view of a retention device in accordance with a first embodiment of the invention.

The position of the friction members 14, 16 is such that the height of the space 28 as viewed in FIG. 1 (i.e. the distance between the second ends 22, 24) is smaller than the diameter of the post 36. Therefore the friction members 14, 16 act as built-in cantilevers and are elastically deformed at their first ends 14, 16 and along their lengths in order to widen the space 28 to accommodate the post 36.

Applying force to the post 36 in the first direction 32 creates a friction force between the post 36 and the friction members 14, 16 resulting in the second ends 22, 24 being urged in the first direction and urging the space 28 to open. The retention device can therefore be easily assembled onto the post 36 such that the piece of jewellery can be secured, as the frictional force caused by the mere elastic resilience of the friction members 14, 16 is relatively small.

Applying force to the post 36 in the second direction 32 also creates friction between the post 36 and the friction members 14, 16 resulting in the second ends 22, 24 being urged in the second direction and urging the space 28 to close on the post 36. This closing action increases the clamping force exerted by the friction members 14, 16 which in turn increases the frictional force on the post 36. The more force that is applied to the post 36, the higher the clamping force will be and consequently movement of the retention device 10 in the second direction is made either difficult or prevented completely.

Therefore the retention device 10 is easily placed onto the post 36 in order to secure the piece of jewellery (not shown) in place, but accidental removal is made difficult.

Figure 4:
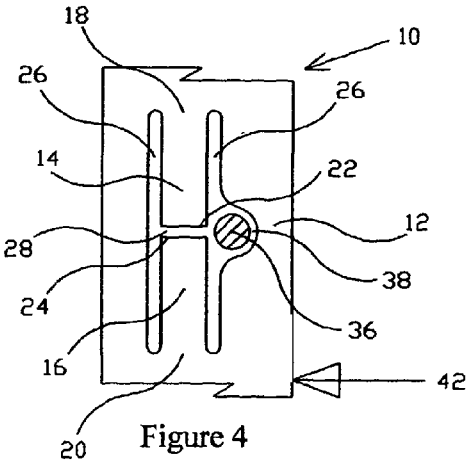
FIG. 4 is a front view of the retention device of FIG. 1 with post disengaged.
Figure 5:
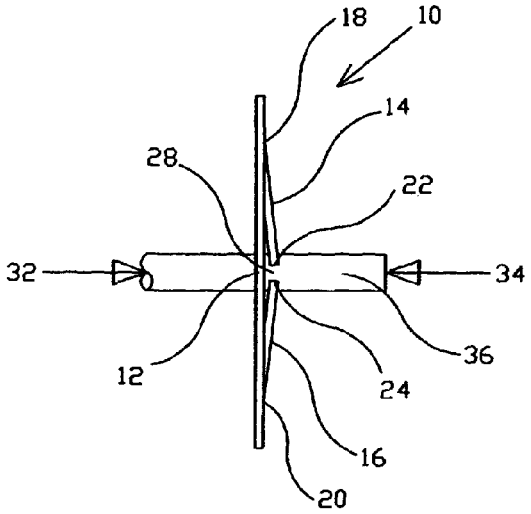
FIG. 5 is a side view of the retention device of FIG. 1 with post disengaged.

FIGS. 4 and 5 show the disengagement of frictional clamping force of members 14 and 16 from the post 36. With post 36 inserted between members 14 and 16 as shown in FIGS. 2 and 3, applying lateral force to the main body 12 in the direction 42 whilst retaining the lateral position of post 36 urges the disengagement of the post from the friction members 14 and 16. The eventual relocation of the post 36 to a position within the receiving region 38 shown in FIGS. 4 and 5 enables the unobstructed removal of post 36 from body 12.

Figure 6:
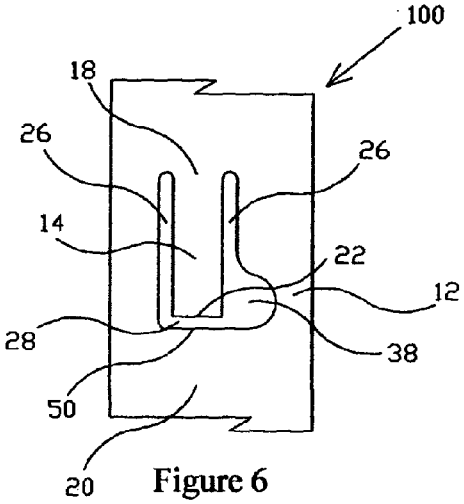
FIG. 6 is a front view of a retention device in accordance with a second embodiment of the invention.
Figure 10:
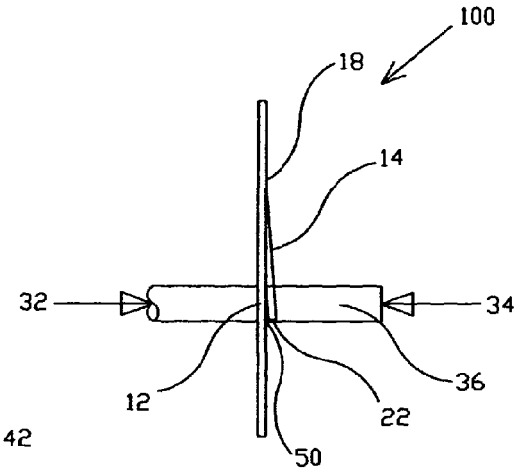
FIG. 10 is a side view of the retention device of FIG. 6 with post disengaged.
Figure 11:
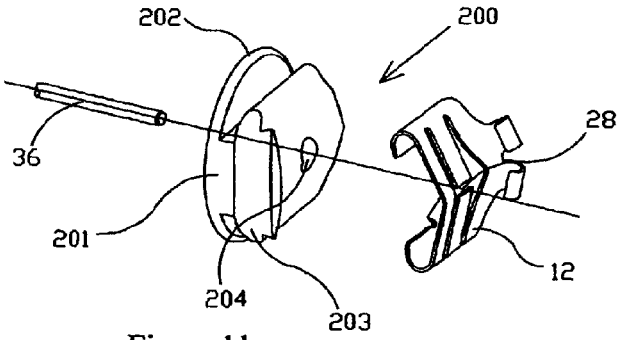
FIG. 11 is a perspective view of a retention device in accordance with a third embodiment of the invention.
Figure 12:
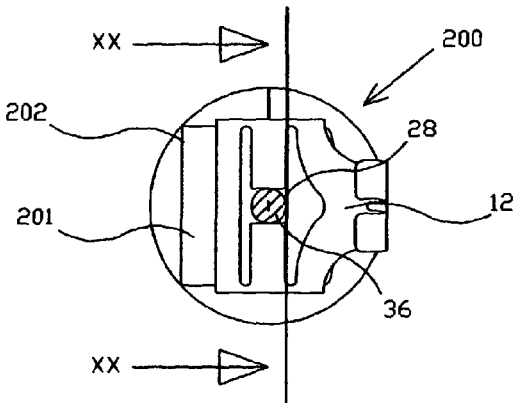
FIG. 12 is a front view of the retention device of FIG. 11 with post inserted.
Figure 13:
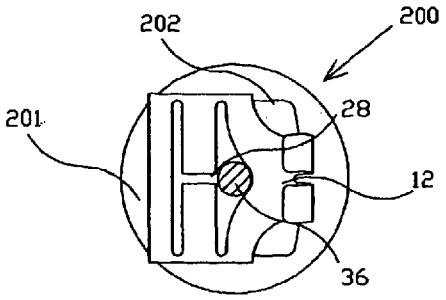
FIG. 13 is a front view of the retention device of FIG. 11 with post disengaged.
Figure 14:
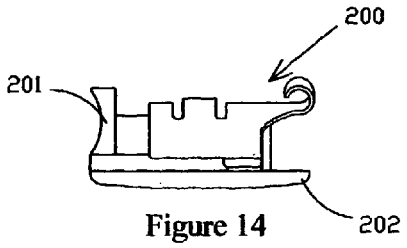
FIG. 14 is a side view of the retention device of FIG. 11.
Figure 15:
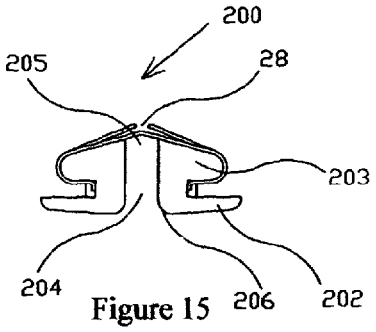
FIG. 15 is a section view of the retention device of FIG. 12 along line XX-XX.

The retention device 100 shown in FIGS. 6, to 10 is similar to retention device 10 of the first embodiment, with the difference that the retention device 100 comprises only a single friction member 14. The device 100 operates in the same way as device 10, except that a clamping force is only provided on a single side of the post 36, and is reacted by an abutment in the form of a reaction surface 50 of the space 28.

Figure 7:
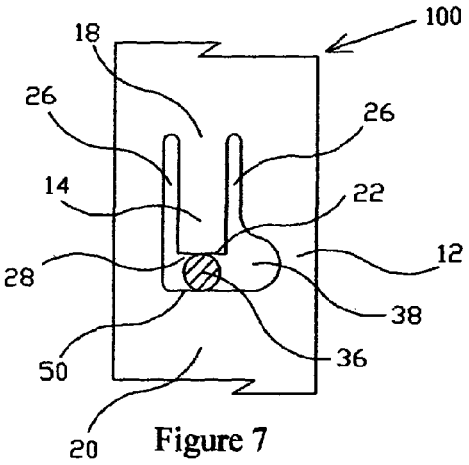
FIG. 7 is a front view of the retention device of FIG. 6 with post inserted.
Figure 8:
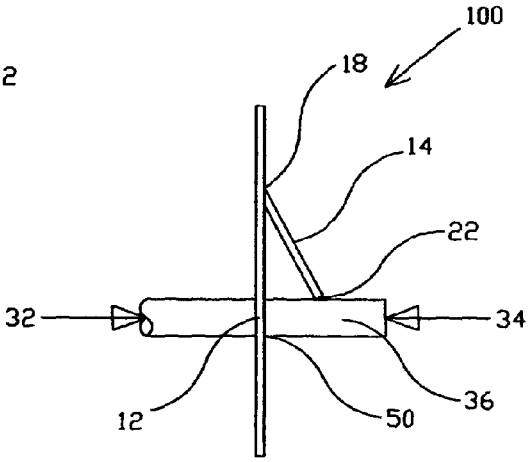
FIG. 8 is a side view of the retention device of FIG. 7 with post inserted.
Figure 9:
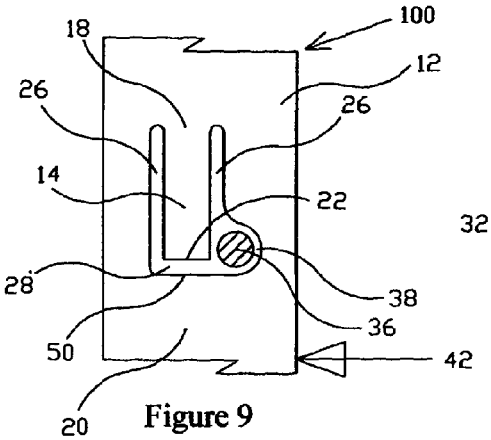
FIG. 9 is a front view of the retention device of FIG. 6 with post disengaged.

FIGS. 9 and 10 show the manner of removal of the retention device from the post 36. With post 36 inserted between members 14 and reaction surface 50 as shown in FIGS. 7 and 8, applying lateral force to the main body 12 in the direction 42 whilst retaining the lateral position of post 36 creates a sliding movement between the post and surfaces 22 and 50. The eventual relocation of the post 36 to a position within the receiving region 38 as shown in FIGS. 9 and 10 enables the unobstructed removal of post 36 from body 12. This embodiment is simpler and less expensive and time consuming to produce.

In a third embodiment, FIGS. 11 to 15 show a retention device 200 substantially similar to retention device 10, except that retention device 200 comprises a main body 12 in combination with a post guide component in the form of a guide body 201. Guide body 201 is a unitary body comprising a circular plate portion 202 and a semi oval section 203. A circular orifice 204 extends through the body 201 and is co-axial with the space 28 and direction of post insertion. The end of the orifice 205 (see FIG. 15) proximate the main body is convergent in the insertion direction, as formed by chamfer 206, and as such insertion of the post is made easier.

In use, the main body 12 partially wraps around the semi oval section of the guide body 203. Upon insertion of the post 36 into the body 201, the post is guided by cylindrical section 204 towards the space 28, preventing misalignment of the post 36 which could impede the function of the retention device 200.

It should be noted that in order to function satisfactorily, the retention devices 10, 100, and 200 should be constructed such that the deformation induced by the applied compressive force 42 remains elastic; i.e. such that the retention device is capable of returning to its undeformed state upon release. In retention devices 10, 100, and 200 the body 12 should be sufficiently strong in the areas adjacent the friction members 14, 16 for this to occur.

As well as the above features, the dimensions of the retention device should be selected to provide the appropriate level of clamping force.

The clamping force provided by the free arms 14 and 16 may be increased by pretensioning them; i.e. by forming body 12 such that surfaces 22 and 24 provide a clamping force on post 36 in the rest position shown in FIG. 3.

Figure 16:
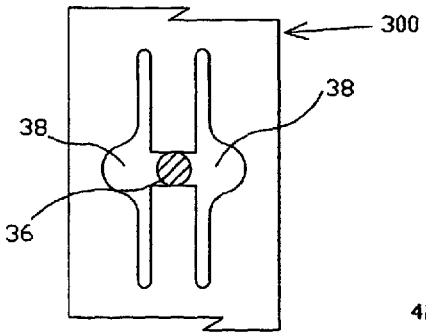
FIGS. 16 and 17 show a fourth embodiment with a post respectively in an engaged and a disengaged position.
Figure 17:
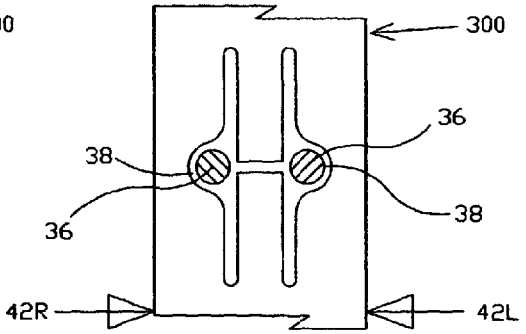

FIGS. 16 and 17 show a retention device 300 substantially similar to that of FIG. 1 but provided with two post receiving regions 38. A post 36 can be moved from between two friction members to either of the post receiving regions 38 as shown in FIG. 17 by lateral movement in either of the directions 42R and 42L.

Figure 18:
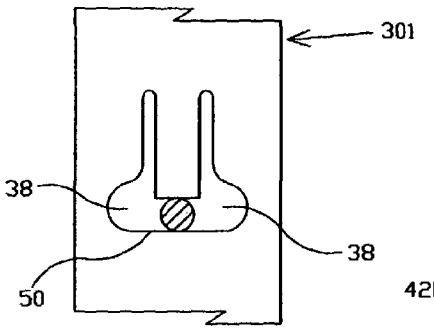
FIGS. 18 and 19 show a fifth embodiment with a post respectively in an engaged and a disengaged position.
Figure 19:
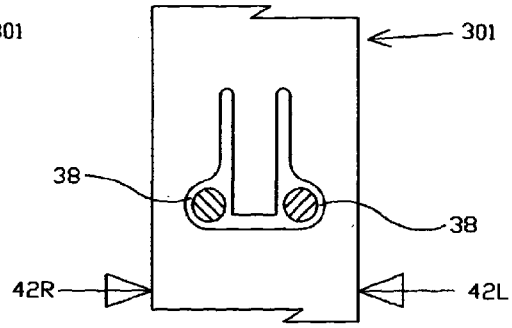

Substantially similarly, FIGS. 18 and 19 show a variation of the embodiment of FIG. 6 and in which a retention device 301 comprises two post receiving regions 38 into either of which a post may be moved from between a friction member and abutment 50 provided by the body.

Figure 20:
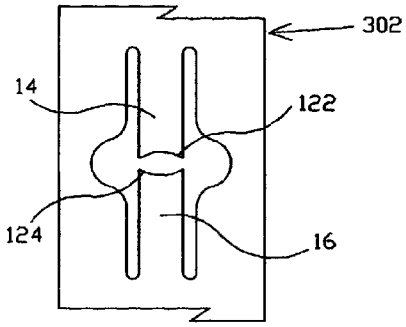
FIGS. 20 and 21 show a sixth embodiment with a post respectively in an engaged and a disengaged position.
Figure 21:
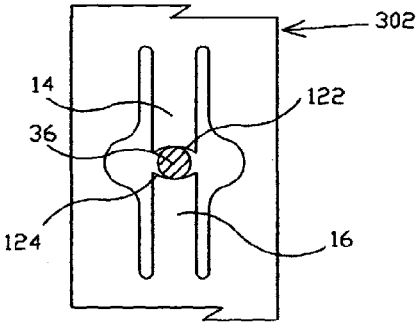

FIGS. 20 and 21 show a retention device 302 substantially similar to that of FIGS. 16 and 17 but with confronting ends of the two friction members 14, 16 each provided with a recess region 122, 124. That recess may, for example, be curved or V shaped. The recesses facilitates centralisation of the post between the friction members 14, 16 and also assist in providing a retention device in which the force required for lateral disengagement can be more accurately designed and predicted.

Figure 22:
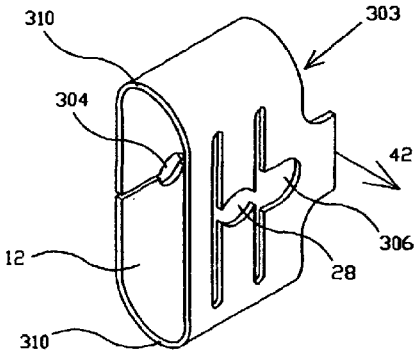
FIG. 22 is a perspective view of a retention device in accordance with a seventh embodiment.

In the retention device 303 of FIG. 22 the body 12 comprises curved end regions 310 which lead to two confronting planar portions the confronting ends of which define an opening 304 which acts as a guide for insertion of a post, thereby to guide the post to between confronting ends of the friction members. In this embodiment the lateral movement required for disengagement of a post from between the friction members is achieved by a component of the rotational movement in the direction 42 such that, in effect, the post is tilted about the opening 304. Thus the part of the post previously retained between the friction members is displaced to the post-receiving region 306.

Figure 23:
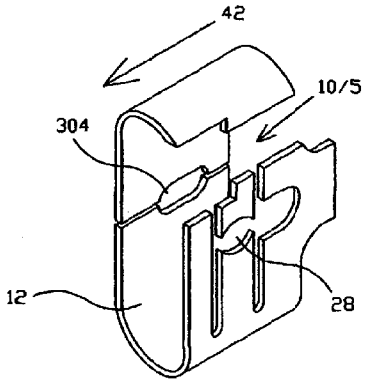
FIG. 23 is a perspective view of a retention device, part cut away for clarity, in accordance with an eighth embodiment.

FIG. 23 shows a variation of the retention device of 22 and in which the post guide opening 304 is elongate. Thus movement to disengage a post may be either by substantially lateral movement or a combination of lateral movement in the direction 42 of FIG. 23 and rotational movement in the direction 42 of FIG. 22.

FIGS. 24 to 26 show a variation of the embodiment of FIGS. 11 to 14. In this embodiment body 12 is of a V shape as viewed in a sideways direction and comprises two regions each co-planar with a respective one of the two friction members. The body 12 is movable laterally relative to the guide 201 in a direction 42 to lie either at the orientation of FIG. 25 at which it is ready to receive a post 307 or the orientation of FIG. 26 at which a post lies in the receiving region 306 from which it is freely removable. In this construction it is necessary to manually slide the body and guide relative to one another to the orientation of FIG. 25 subsequent to removal of a post.

To avoid the need for manual operation the retention device 305 may incorporate a spring bias arrangement as shown in more detail in FIGS. 27 to 30. For the purpose of automatic return the body 12 is made of spring steel and comprises obliquely orientated extensions 61 which bear against inclined guide surfaces 62 on the guide body 201. The application of lateral force to the main body 12 in the direction 42 of FIGS. 25 and 26 causes the extensions 61 to separate from one another as they climb but remain on the respective guide surfaces 62. When a lateral force 42 is removed from the body and no post is present, the main body returns to the configuration shown in FIG. 25 in consequence of the spring energy stored in the main body 12 and which urges the obliquely orientated extensions 61 to slide down the guide surfaces 62.

Numerous changes can be made within the scope of the present invention. For example the retention device does not have to be a single piece, and can be constructed from a multi-piece assembly with, for example, the friction members as separate components.

The friction members can be biased with separate biasing means, for example springs.

The retention device need not be constructed from metal, and can be constructed, for example, from a plastics material.

The retention device may incorporate any more than two friction members, in different orientations; for example two pairs of transversely oriented friction members may be employed to provide additional clamping force.

The retention device can be used on various types of jewellery, for example earrings wherein the post is attached to the earring, and necklaces/bracelets wherein the post is attached to a first end of the necklace/bracelet and the retention device is attached to a second end.

The invention claimed is:

1. A jewelry retention device suitable for retaining a jewelry item which comprises a retention post, said retention device comprising a body comprising a first friction member having a first end connected to the body and a second end which is free, said first friction member being generally flat between the first and second ends thereof, said body additionally comprising a second friction member which comprises a surface that confronts said second end of the first friction member, said second end of the first friction member and said surface of the second friction member defining a space therebetween, the second end of the first friction member being movable in a first direction by elastic deformation of the device to increase a height of said space as viewed in a plane perpendicular to the first direction, the body defining a first receiving region adjacent to and communicating with said space, said first receiving region having a height and width as viewed in said plane that are each substantially greater than a height of said space when viewed in said plane and said first friction member is in an unbiased condition; and said retention device further comprising a guide component provided with an aperture configured to accommodate a post extending therethrough, said body providing support for said guide component, said guide component being slidable relative to the body in a direction perpendicular to a direction in which the aperture extends through the body.

2. The jewelry retention device according to claim 1, further comprising a second receiving region into which a post may be laterally displaced and received for subsequent substantially free withdrawal.

3. The jewelry retention device according to claim 2, wherein said first and second receiving regions are positioned symmetrically at respective ends of said confronting surfaces of the second end of said first friction member and the second friction member.

4. The jewelry retention device according to claim 1, wherein said first friction member and body are formed integrally with one another.

5. The jewelry retention device according to claim 1, wherein the body is substantially planar and said first friction member is co-planar with said body.

6. The jewelry retention device according to claim 1, wherein said first friction member is oriented at an oblique angle relative to said body.

7. The jewelry retention device according to claim 1, wherein the second end of said first friction member and the second friction member are spaced by a predetermined distance.

8. The jewelry retention device according to claim 1, wherein the body is made of spring steel and comprises obliquely oriented extensions which bear against obliquely inclined guide surfaces on the guide component thereby to urge the body and guide component to move relative to one another.

9. The jewelry retention device according to claim 1, wherein the guide component in an unbiased condition rests at a position at which it is aligned with a position between said first friction member and said second friction member.

10. A jewelry retention device suitable for retaining a jewelry item, said retention device comprising a body having a first friction member and a second friction member, wherein the first friction member has a second end which confronts the second friction member to define therebetween a space, the second end of the first friction member and the second friction member being moveable relative to one another in a first direction by elastic deformation of the body thereby to vary the size of said space, the body, as viewed in a plane perpendicular to the direction of insertion of the post between the second end of the first friction member and the second friction member, further defining a first receiving region adjacent said space between the second end of the first friction member and the second friction member, said first receiving region having a height and width as viewed in said plane that are each substantially greater than a height of said space when viewed in said plane and said first friction member is in an unbiased condition, said retention device further comprising a guide component mounted for sliding movement relative to said body, said guide component providing support for said body and on which the body is guided for sliding movement relative to said guide component in a lateral direction which is parallel to said plane, the guide component comprising a guide orifice, and said guide component and body being moveable relative to one another between a first position in which the guide orifice of the guide component is aligned with said space and a second position in which the guide orifice of the guide component is aligned with said first receiving region adjacent said space.

11. The jewelry retention device according to claim 10, wherein the body is made of spring steel and comprises obliquely oriented extensions which bear against obliquely inclined guide surfaces on the guide component whereby the guide component is biased normally to rest at a position at which the guide orifice of the guide component is aligned with said space between confronting surfaces of the first friction member and the second friction member.

12. The jewelry retention device according to claim 10, wherein said first friction member is planar between the first and second ends thereof.

13. The jewelry retention device according to claim 10, wherein said first friction member is planar between the first and second ends thereof and wherein the body is made of spring steel and comprises obliquely oriented extensions which bear against obliquely inclined guide surfaces on the guide component whereby the guide component is biased normally to rest at a position at which the guide orifice of the guide component is aligned with said space between the confronting surfaces of the first friction member and the second friction member.

14. The jewelry retention device according to claim 10, wherein the body is of a V shape as viewed in a sideways direction and comprises two regions each co-planar with a respective one of said first and second friction members.

15. The jewelry retention device according to claim 11, wherein the guide component is biased to rest at said first position.

* * * * *